US006087963A

United States Patent [19]

Kobayashi et al.

[11] Patent Number: 6,087,963

[45] Date of Patent: Jul. 11, 2000

[54] VEHICLE-MOUNTED DEVICE FOR AUTOMATIC CHARGE RECEIPT SYSTEM

[75] Inventors: Kenji Kobayashi, Yokohama; Toshiyuki Sakamoto, Fujisawa; Yasunari Tanaka, Mito, all of Japan

[73] Assignee: Hitachi, Ltd., Tokyo, Japan

[21] Appl. No.: 08/908,197

[22] Filed: Aug. 7, 1997

[30] Foreign Application Priority Data

Aug. 9, 1996 [JP] Japan ..... 8-210812

[51] Int. Cl.[7] ..... G08G 1/00

[52] U.S. Cl. ..... 340/928; 340/933; 340/825.34; 235/384

[58] Field of Search ..... 340/928, 933, 340/937, 825.31, 825.34, 541; 235/379, 380, 384

[56] References Cited

U.S. PATENT DOCUMENTS

| | | | |
|---|---|---|---|
| 4,448,321 | 5/1984 | Hanlet | 220/4 R |
| 4,926,480 | 5/1990 | Chaum | 380/23 |
| 5,085,435 | 2/1992 | Rossides | 273/138 A |
| 5,310,999 | 5/1994 | Claus et al. | 235/384 |
| 5,485,520 | 1/1996 | Chaum et al. | 340/825.31 |
| 5,602,919 | 2/1997 | Hurta et al. | 340/928 |
| 5,640,156 | 6/1997 | Okuda et al. | 340/928 |
| 5,729,537 | 3/1998 | Billstrom | 340/825.34 |
| 5,760,709 | 6/1998 | Hayashi | 340/928 |
| 5,774,552 | 6/1998 | Grimmer | 380/25 |

*Primary Examiner*—Jeffery A. Hofsass
*Assistant Examiner*—Van T. Trieu
*Attorney, Agent, or Firm*—Antonelli, Terry, Stout & Kraus, LLP

[57] ABSTRACT

A vehicle-mounted device for an automatic charge receipt system capable of being designed, manufactured and installed while an encrypting/decrypting algorithm and/or encrypting/decrypting keys remain hidden. Included is an arrangement for discrimination (i.e., identification) of a vehicle-mounted device or user each time a utilization charge is determined/settled, wherein an initial portion of communications concerning discrimination is conducted without encrypting/decrypting, and remaining portions of communications are conducted with encrypting/decrypting so as to protect an integrity and security of the automatic charge receipt system. Confindential components/information, e.g., the encrypting/decrypting algorithm and/or keys, and components directly handling such information are arranged within a tamper-/access-resistant unit (preferably as a sealed integrated circuit package) in the vehicle-mounted device. Since an encryptor and a decryptor directly read the encrypting/decrypting key without such key being detectable outside of the sealed unit, it is not necessary for components outside the sealed unit to receive and/or handle the aforesaid encrypting/decrypting key or their contents. Accordingly such key remains hidden (i.e., inaccessable) within the sealed unit. The arrangement can further include an authentication protocol such as a 3-way authentication protocol, a 2-way×2 authentication protocol and a Fiat-Shimir authentication protocol.

22 Claims, 7 Drawing Sheets

VEHICLE-MOUNTED DEVICE FOR AUTOMATIC CHARGE RECEIPT SYSTEM

BACKGROUND OF THE INVENTION

1. Field of the Invention

This invention relates to an automatic charge receipt system for automatically collecting a utilization (i.e., toll) charge pertaining to vehicle/use information and utilization charge information as communicated between a vehicle running on a utilization charge road (i.e., toll road) and a road-side device (toll booth) installed in a road-side system, and to a vehicle-mounted device to be installed on the vehicle for effecting such communication.

2. Description of Related Art

In recent years, there has been studied an automatic charge receipt system for automatically collecting a charge (i.e., toll) from a vehicle running on a charged road. This technology is operated such that a road-to-vehicle communication is carried out using an electromagnetic wave communication between a vehicle-mounted device installed on the vehicle and a road-side device installed in a road-side system (e.g., toll both) so as to exchange information about charge payment so as to determine/settle a utilization charge. Examples of automatic charge collection systems include the "Electric Toll Collection" system in Japan, "Auto Fee Collection" system in Europe, and "Fastoll" system in the United States.

As a practical settlement met hod, it has been proposed that information on a current expendable balance (e.g., an electronic cash balance on account) is written in advance in the vehicle-mounted device in place of cash, for example, via pre-paid toll cards. A request for information on a utilizing charge is sent from the road-side device to the vehicle-mounted device as a charge is incurred (e.g., as the vehicle passes the toll booth), and then a utilization charge is subtracted within the vehicle-mounted device from the current expendable balance.

In addition, in order to determine an appropriate charge in reference to a travel route which the vehicle uses (e.g., point of entrance of the toll road) and information about the type of vehicle (e.g., truck/car, number of axles, private/commercial status, etc.), it has been considered to adapt the vehicle-mounted device to also transmit information about the route or the type of vehicle to the road-side device.

In the aforesaid automatic charge receipt system, information concerning money is exchanged and settled using communication transmission, and accordingly, it is necessary to provide a countermeasure (i.e., to protect an integrity and security) for preventing any irregular utilization or theft via interception and/or modification of the content of communication. As one countermeasure, there can be considered an encrypting/decrypting of the content of communication.

In the case that a communication performed between the road-side device and the vehicle-mounted device is encrypted, the road-side device has to be able to decrypt the encrypted communication transmitted by a large number of random vehicle-mounted devices. Due to this fact, algorithms for encrypting/decrypting must be at least unified in an entire automatic receipt system. In addition, there may be applied a method for installing a different encrypting/decrypting key within every vehicle-mounted device or a method for installing one common key over an entire automatic charge receipt system. With respect to such keys, it is necessary to securely distribute and monitor the encrypting/decrypting keys in such a way that they may not be leaked out and used to thwart the charge receipt system.

As one complicating factor, designing and manufacturing of the vehicle-mounted device are not always necessarily carried out by a centralized manager for an automatic charge receipt system, because the designing and manufacturing of various kinds of vehicle-mounted devices in compliance with various kinds of vehicles can be more effectively and efficiently carried out by a vehicle manufacturer rather than the manager. In such a case where numerous vehicle manufacturers are manufacturing/installing vehicle-mounted devices, a number of persons having access to an encrypting/decrypting algorithm or encrypting/decrypting keys is increased and it becomes hard to monitor them in such a way that they may not be leaked out. In addition, from the standpoint of the vehicle manufacturer, it is not essential for such manufacturer to handle an encrypting/decrypting algorithm or keys, and so it is preferable to enable vehicle-mounted devices to be manufactured/installed while encrypting/decrypting algorithms and keys remain hidden.

SUMMARY OF THE INVENTION

It is an object of the present invention to provide a vehicle-mounted device for an automatic charge receipt system capable of being designed, manufactured and installed while an encrypting/decrypting algorithm and/or encrypting/decrypting keys remain hidden.

Further, it is a second object of the present invention to provide an arrangement wherein vehicle manufacturers handling/installing vehicle-mounted devices and a centralized toll manager for providing/controlling encrypting/decrypting keys are different from each other.

Another object is to provide an arrangement for discrimination (i.e., identification) of a vehicle-mounted device or user each time a utilization charge is determined/settled, wherein an initial portion of communications concerning discrimination is conducted without encrypting/decrypting, and remaining portions of communications are conducted with encrypting/decrypting so as to protect an integrity and security of the automatic charge receipt system.

A still further object of the present invention is to provide confindential components/information, e.g., the encrypting/decrypting algorithm and/or keys, of the charge receipt system within a tamper-/access-resistant unit in the vehicle-mounted device.

In order to solve the aforesaid problem, there are provided an encryptor/decryptor arrangement between a vehicle-mounted controller (controlling a processing of receipt information or performing displaying within the vehicle) and a communicator (having a function to communicate with the road-side device), and further, there is provided a memory storing an encrypting/decrypting key required for encrypting/decrypting operations so as to enable the aforesaid encryptor and the aforesaid decryptor to perform a necessary processings with respect to the information.

Since the aforesaid encryptor and the aforesaid decryptor directly read the encrypting/decrypting key without such key being detectable outside of the sealed encryptor/decryptor unit, it is not necessary for the aforesaid vehicle-mounted controller utilizing the aforesaid encryptor and the aforesaid decryptor to receive and/or handle the aforesaid encrypting/decrypting key or their contents. Accordingly such key remains hidden (i.e., inaccessable) within the sealed encryptor/decryptor unit.

In addition, since the transferring of the encrypting/decrypting key is limited only to the memory, and from the memory to the aforesaid encryptor and the aforesaid decryptor, it becomes easy to monitor a prevention of leakage of the encrypting/decrypting keys. More particularly, as alluded to above, a discrimination information memory, encrypting/decrypting key memory, encryptor, decryptor and at least portions of a discrimination forwarder are provided in a tamper-/access-resistant unit so as to further protect an integrity/security of the encrypting/decrypting algorithm and key. The tamper-/access-resistant unit can more specifically be an integrated circuit. Less preferably, the tamper-/access-resistant unit can be at least one of a welded-sealed unit, an epoxy- or resin-sealed unit and a unit which at least one of self-destructs and self-disables upon unauthorized tampering/access thereof.

The arrangement further can include a selector arrangement which is selectably controllable so as to allow communications to be handled within the vehicle-mounted device (and road-side device) with or without encrypting/decrypting.

The foregoing and other objects, advantages, manner of operation, novel features and a better understanding of the present invention will become apparent from the following detailed description of the preferred embodiments and claims when read in connection with the accompanying drawings, all forming a part of the disclosure hereof this invention. While the foregoing and following written and illustrated disclosure focuses on disclosing embodiments of the invention which are considered preferred embodiments, it should be clearly understood that the same is by way of illustration and example only and is not to be taken by way of limitation, the spirit and scope of the present invention being limited only by the terms of the appended claims.

BRIEF DESCRIPTION OF THE DRAWING(S)

The following represents brief descriptions of the drawings, wherein.

DETAILED DESCRIPTION OF THE PREFERRED EMBODIMENTS OF THE INVENTION

Figure 1:
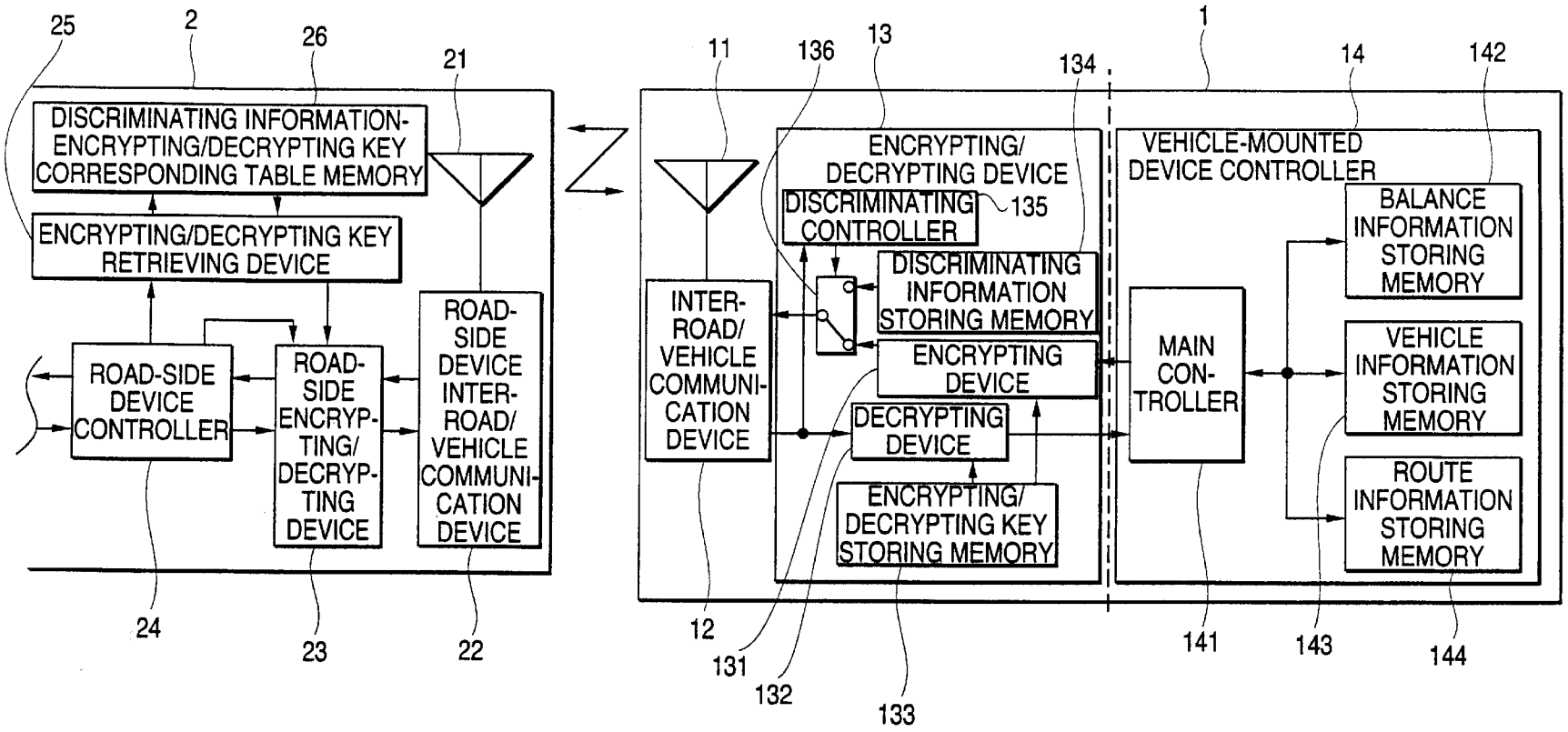
FIG. 1 is a block diagram showing one preferred embodiment of the present invention.

Before beginning a detailed description of the subject invention, mention of the following is in order:

When appropriate, like reference numerals and characters are used to designate identical, corresponding or similar components in differing figure drawings.

A first preferred embodiment of a vehicle-mounted device of an automatic charge receipt system of the present invention will be described with respect to FIG. 1. In FIG. 1, reference numeral 1 denotes an entire vehicle-mounted device and reference numeral 2 denotes a road-side device. The vehicle-mounted device 1 is comprised of: an antenna 11 for communicating with the road-side device 2; an inter-road/vehicle communication device 12 connected to the antenna 11; a vehicle-mounted device controller 14 for processing a charge receipt; and an encrypting/decrypting device 13 placed between a vehicle-mounted device controller 14 and the inter-road/vehicle communication device 12. The encrypting/decrypting device 13 is comprised of: an encryptor 131; a decryptor 132; an encrypting/decrypting key storing memory 133; a discriminating information storing memory 134; a discriminating controller 135; and a switch 136.

The vehicle-mounted device controller 14 is comprised of: main controller 141 for controlling the entire vehicle-mounted controller 14; a balance information storing memory 142 for storing information about a balance on account; a vehicle information storing memory 143 for storing a vehicle type information pertaining to the vehicle in which the vehicle-mounted device 1 is installed (e.g., car/truck/bus, number of axles, weight, vehicle identification number, user, etc.); and, a route information storing memory 144 for recording and storing a route which a vehicle uses (e.g., entrance point of toll road system, routes take within the toll road system, etc.).

The road-side device 2 is comprised of: a road-side antenna 21 for use in communicating with the vehicle-mounted device 1; an inter-road/vehicle communication device 22 connected to the antenna 21 of the road-side device; a road-side device controller 24 for use in controlling a communication of authentication and charge receipt; a road-side encrypting/decrypting device 23 placed between the inter-road/vehicle communication device 22 and the road-side control device 24; encrypting/decrypting key retrieving device 25; and a memory 26 for storing a discriminating information encrypting/decrypting key corresponding table. The road-side device 2 can include further components such as a displaying device or the like. However, such components are not related to an essential content of the present invention and thus are not illustrated in FIG. 1.

The inter-road/vehicle communication device 12 transmits information delivered from the encrypting/decrypting device 13 to the road-side device 2 using the antenna 11. In addition, information sent from the road-side device 2 is received using the antenna 11, is processed through the inter-road/vehicle communication device 12 and is delivered to the encrypting/decrypting device 13.

The encryptor 131 (within the encrypting/decrypting device 13) changes a communication sent from the vehicle-mounted controller 14 into an encrypted communication, delivers it to the inter-road/vehicle communication device 12. In contrast, the decryptor 132 receives an encrypted communication from the inter-road/vehicle communication device 12, decrypts it, and after that, the decryptor 132 delivers it to the vehicle-mounted device controlled 14. Further, an encrypting/decrypting key storing memory 133 stores and supplies an encrypting/decrypting key to the encryptor 131 and the decryptor 132 for use in the encrypting/decrypting operations. A discrimination information storing memory 134 has, as its content, information discriminating (i.e., uniquely identifying) the vehicle-mounted device from other vehicle-mounted devices, and this information and the aforesaid encrypting/decrypting key are set by a manager of the automatic charge receipt system in advance into the discriminating information storing memory 134 and the encrypting/decrypting key storing memory 133, respectively. Further, the manager of the automatic charge receipt system may record a corresponding relation between all the discriminating information and the encrypting/decrypting keys of the vehicle-mounted devices in the discriminating information encrypting/decrypting key corresponding table memory 26.

A switch 136 selects an input supplied to the inter-road/vehicle communication device 12 between the encryptor 131 and the discriminating information storing memory 134 under a control of the discriminating controller 135. The discriminating controller 135 controls the switch 136 when an inter-road/vehicle communication is started and sends the discriminating information showing a content of the aforesaid discriminating information storing memory 134 without encrypting to the road-side device 2 through the inter-road/vehicle communication device 12. The discriminating information transmitted from the vehicle-mounted device 1 is received at the road-side device antenna 21 and is sent to the road-side device controller 24 through the encrypting/decrypting device 23 in the road-side device. When the inter-road/vehicle communication is first started (i.e., during an intial period thereof), the encrypting/decrypting device 23 in the road-side device is not operated, such that the non-encrypted discriminating information transmitted from the vehicle-mounted device 1 reaches the controller 24 of the road-side device without encryption/decryption processing.

When the discriminating information is sent and received, the road-side device controller 24 forwards the discriminating information to the encrypting/decrypting key retrieving device 25. The encrypting/decrypting key retrieving device 25 retrieves an appropriate encrypting/decrypting key corresponding to the sent discriminating information from the discriminating information encrypting/decrypting key corresponding table memory 26, and provides the same to the road-side encrypting/decrypting device 23. Since the encrypting/decrypting key obtained should then be the same as one set by the manager of the automatic charge receipt system in the vehicle-mounted device 1, the road-side device 2 becomes equiped with the same encrypting/decrypting key as the key in the vehicle-mounted device 1. Subsequently, the vehicle-mounted device controller 14 and the road-side device controller 24 may start a communication for charge receipt which is encrypted/decrypted by the vehicle encrypting/decrypting device 13 and the road-side encrypting/decrypting device 23.

A main controller 141 of the vehicle-mounted device controller 14 sends information about the vehicle type or route under a predetermined order and/or timing to the road-side device 2 during a charge determination phase of the process. In addition, in response to the main controller 141 receiving information about a charge as determined by the road-side device 2, the value is subtracted from the balance information stored in the balance information storing memory 142, and a new balance information is written into the balance information storing memory 142 so as to settle (i.e., deduct) the charge.

The road-side device 2 and the vehicle-mounted device controller 14 communicate with each other concerning information about charge pertinent information and a charge determination through the aforesaid operation so as to settle the charge. During that period, the encrypting/decrypting device 13 installed on the vehicle performs encrypting/decrypting processings on the communications, and thus the vehicle-mounted device controller 14 is not required to perform such encrypting/decrypting processings. In particular, the encrypting/decrypting key which is required to be secured and managed against leakage, can be so secured within the vehicle-mounted device by being inaccessibly contained within the encrypting/decrypting device 13, so that algorithm/key access and useage can be limited to the encrypting/decrypting device 13. Since it is not necessary to include the vehicle-mounted device controller 14 as a secure part of the device for prevention of leakage, its design, manufacturing and distribution may become easy.

Figure 7:
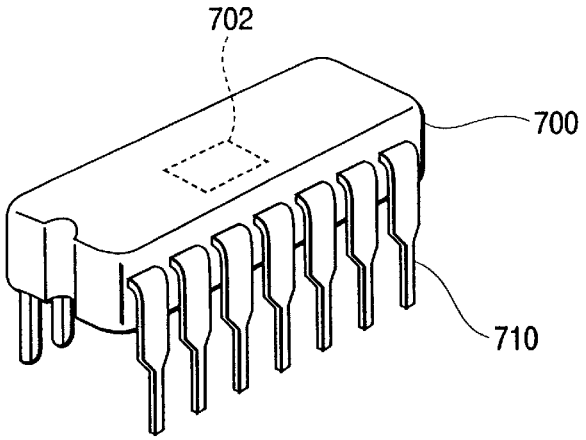
FIG. 7 is a persective view of an integrated circuit embodiment of the present invention.
Figure 8:
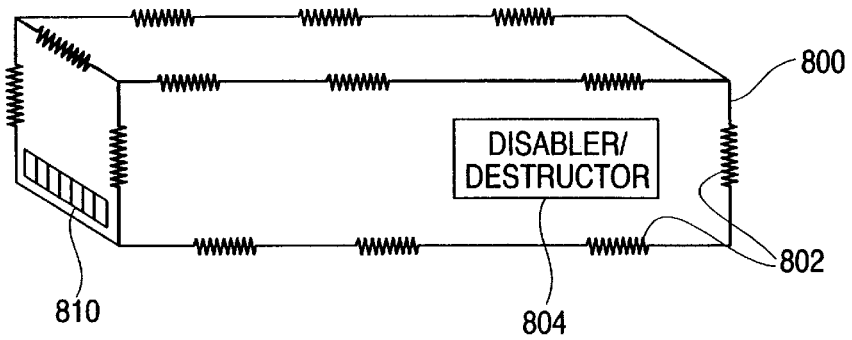
FIG. 8 is a persective view of a welded-sealed unit embodiment of the present invention.
Figure 9:
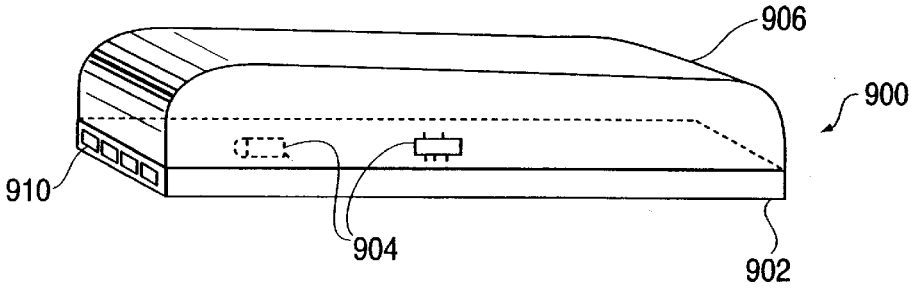
FIG. 9 is a persective view of an epoxy- or resin-sealed unit embodiment of the present invention.

In order to improve an integrity/security of the encrypting/decrypting algorithm and key within the vehicle-mounted device, in a preferred embodiment, sensitive components and/or information related to encryption/decryption are provided in a tamper-/access-resistant unit. More particularly, as one example, a discrimination information memory, encrypting/decrypting key memory, encryptor, decryptor and at least portions of a discrimination forwarder are provided in a tamper-/access-resistant unit. The tamper-/access-resistant unit can more specifically be an integrated circuit 702 (FIG. 7) contained within a sealed package 700. It should be noted that while encrypted/decrypted information can be input/output from the integrated circuit 702 via access terminals 710, an encryption/decryption algorithm and key cannot be accessed via terminals 710, thus to represent a high level of algorithm/key integrity and security. Less preferably, the tamper-/access-resistant unit can be a welded-sealed unit 800 (FIG. 8) being sealed with welds 802 and having access terminals 810, or an epoxy-sealed unit 900 (FIG. 9) being constructed, for example, of a printed circuit board 902, components 904, a hardened epoxy sealant 906 and having access terminals 910. Further, any of such units can have a disabler/destructor arrangement 804 (e.g., fusible links, induced short circuiting, etc.) which results in permanent disablement or destruction of an operation of the vehicle-mounted device in the event of unauthorized tampering/accessing.

Another preferred embodiment of the vehicle-mounted device of an automatic charge receipt system of the present invention will be described with respect to FIG. 2. This preferred embodiment has a feature that, in addition to the construction and function of the previous preferred embodiment, a relative confirmation is carried out between the aforesaid vehicle-mounted device and the aforesaid road-side device. Such confirmation is carried out after starting the communication and before exchanging information about the charge receipt, and before control and running operations are provided in the aforesaid encrypting/decrypting device.

Figure 2:
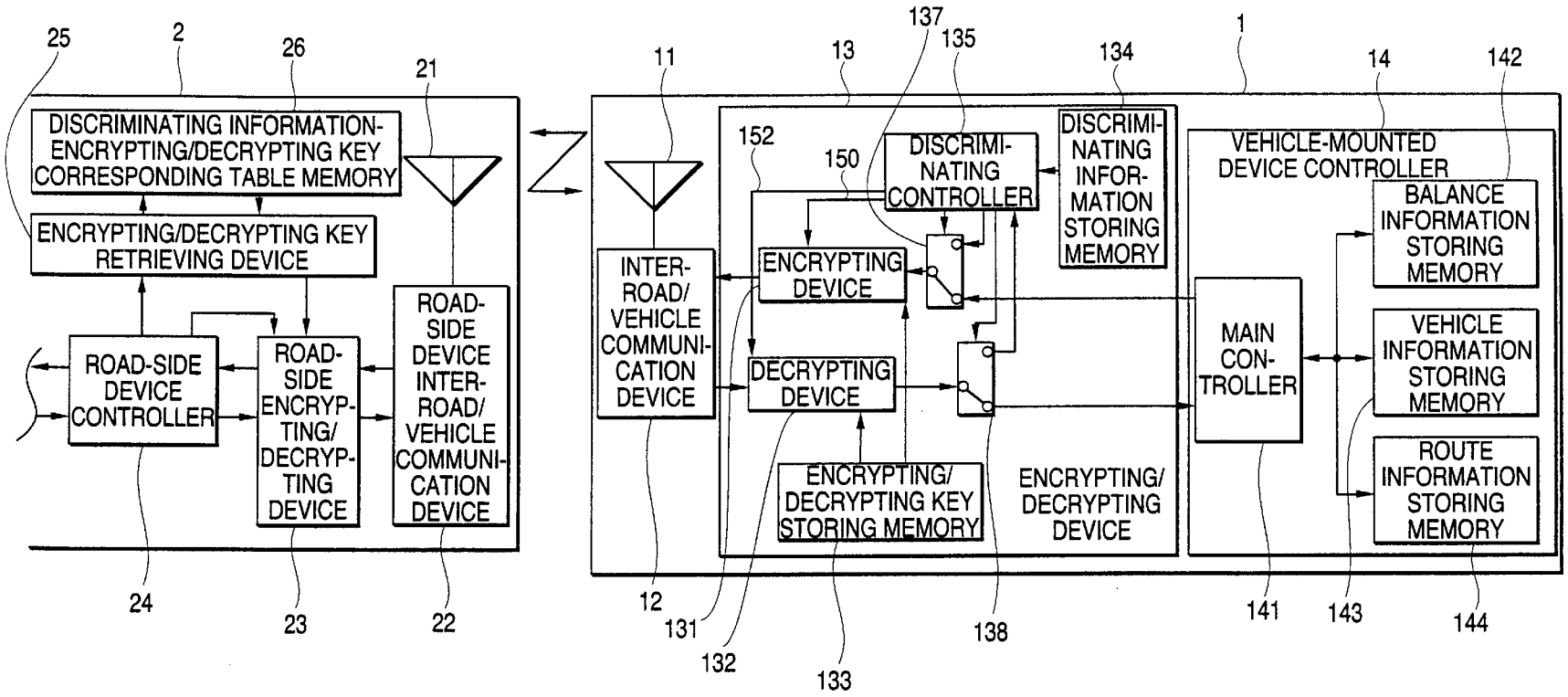
FIG. 2 is a block diagram showing another preferred embodiment of the present invention.

In FIG. 2, since a construction and operation of the antenna 11, the inter-road/vehicle communication device 12 and the vehicle-mounted controller 14 are the same as those of the previous preferred embodiment, redundant description thereof is omitted. Although the road-side device 2 is the same as that of the previous preferred embodiment in terms of construction, its operation will be described together with the operation of the encrypting/decrypting device 13 due to the fact that operation of the road-side device controller 27 is changed in the present embodiment. More particularly, a construction and operation of the encrypting/decrypting device 13 will be described as follows.

The encrypting/decrypting device 13 is comprised of: an encryptor 131; a decryptor 132; an encrypting/decrypting key storing memory 133; a discriminating information storing memory 134; a discriminating and confirming controller 135; and, two switches 137, 138. The encryptor 131 encrypts communication sent from the vehicle-mounted device controller 14 and delivers it to the inter-road/vehicle communication device 12, and the decryptor 132 receives encrypted communication from the inter-road/vehicle communication device 12 and delivers it to the vehicle-mounted device controller 14 after decrypting it. Operation/non-operation of the encryptor 131 and the decryptor 132 are controlled (i.e., selected) by the discriminating and confirming controller 135 using control lines 150, 152, respectively. When the encryptor 131 and decryptor 132 are controlled to a non-operating state, communication is inputted/outputted as it is without encryption/decryption processing.

In addition, the encrypting/decrypting key storing memory 133 storing the encrypting/decrypting key for encrypting/decrypting operations is connected to the encryptor 131 and the decryptor 132, wherein the encryptor 131 and the decryptor 132 obtains the key from the storing memory 133. The discriminating information storing memory 134 has, as its content, information discriminating (i.e., uniquely identifying) the vehicle-mounted device from other vehicle-mounted devices (e.g., via serial number), wherein such information and the aforesaid encrypting/decrypting key are set in advance in the discriminating information storing memory 134 and the key storing memory 133, respectively. In addition, the manager for the automatic charge receipt system records all corresponding relationships between the vehicle-mounted device discriminating information and the encrypting/decrypting keys in the discriminating information encrypting/decrypting key corresponding table memory 26.

The discriminating and confirming controller 135 has a function for sending a discriminating information to the road-side device 2 when the inter-road/vehicle communication is started and another function for making confirmation between the vehicle-mounted device 1 and the road-side device 2 by communicating with the road-side device 2 under a predetermined order. More particularly, a first switch 137 selects an input source for the encryptor 131 between the vehicle-mounted device controller 14 and the discriminating and confirming controller 135, i.e., according to a switching control input from the discriminating and confirming controller 135. A second switch 138 selects over an output from the decryptor 132 to be delivered to one of the vehicle-mounted device controller 14 and the discriminating and confirming controller 135, i.e., according to another switching control input from the discriminating and confirming controller 135.

Figure 5:
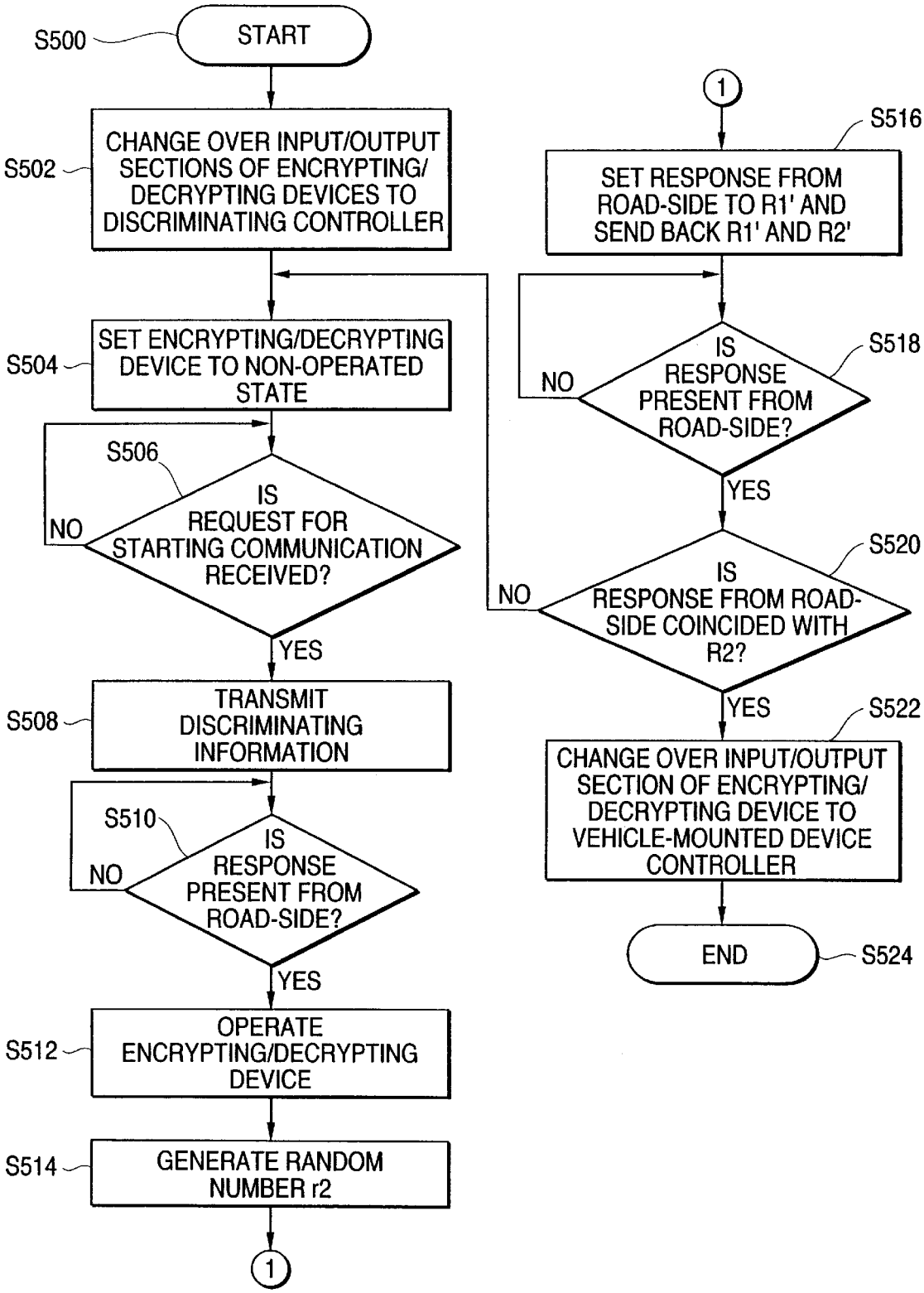
FIG. 5 is a flowchart expressing an operation of a discriminating and confirming controller of FIG. 2.
Figure 6:
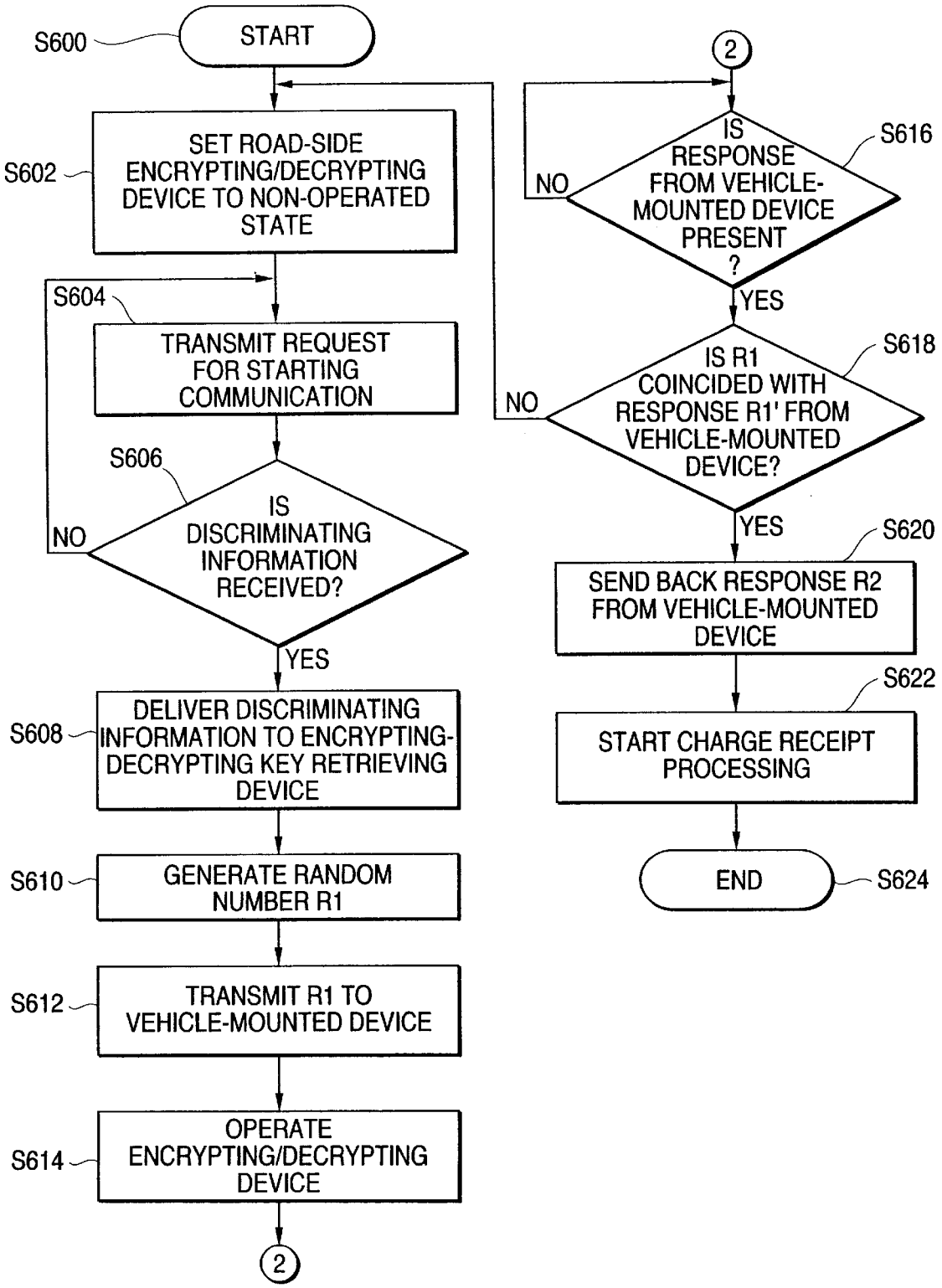
FIG. 6 is a flowchart expressing an operation of a road-side device controller of FIG. 2.

Referring now to FIGS. 5 and 6, operations of the discriminating and confirming controller 135 and the road-side device controller 24 beginning from a starting time of inter-road/vehicle communication to an exchanging of the charge receipt will be described. More particularly, FIG. 5 is a flow chart expressing operations of the discriminating and confirming device 135, and FIG. 6 is also a flow chart expressing operations of the road-side device controller 24. While FIGS. 5 and 6 represent one preferred showing order of the discriminating and confirming operation, it is apparent that there are other orders/arrangements possible to realize other discriminating and confirming operations or sequences.

Referencing FIG. 5, step S500 indicates a start step. In steps S502, S504, the discriminating and confirming controller 135 sets the encryptor 131 and the decryptor 132 to a non-operational state as an initial setting, and the first switch 137 and the second switch 138 are selected to the discriminating and confirming controller 135 terminals. After this operation, it is monitored in a step S506 whether or not a request for starting a communication from the road-side device 2 is received. Such process continues to loop through step S506 until a request for starting a communication is received.

Referencing FIG. 6 with respect to the road-side device 2, step S600 indicates a start step. In step S602, the road-side device controller 24 sets the road-side encrypting/decrypting device 23 to a non-operated state as its initial setting, and uses a step S604 to continuously transmit a request for starting communication using the road-side antenna 21 to any approaching vehicle-mounted device 1. Concurrently, in step S606, it is monitored whether or not a response from a vehicle-mounted device is present. If no response is present, the road-side device 2 continues to loop through steps S604, S606.

As a vehicle and the vehicle-mounted device 1 approach each other and come in a range capable of performing a communication, the request for starting communication transmitted from the road-side device 2 passes through the antenna 11, the inter-road/vehicle communication device 12, the decryptor 132 (kept in a non-operated state) and the second switch 138, and enters the discriminating and confirming controller 135. In response to the discriminating and confirming controller 135 receiving the request in the step S506 for starting communication, the discriminating information is read out of the discriminating information storing memory 134, and is sent (i.e., responded) in a step S508 to the road-side device 2 through the first switch 137, the encryptor 131 (kept in a non-operated state), the inter-road/vehicle communicating device 12 and the vehicle antenna 11. After this operation, the discriminating and confirming controller 135 monitors a response from the road-side device 2, via a step S510. As long as no response is detected, the vehicle-mounted device 1 continues to loop through the step S510.

The discriminating information transmitted from the vehicle-mounted device 1 enters the road-side device controller 24 through the road-side antenna 21, the road-side device inter-road/vehicle communication device 22 and the encrypting/decrypting device 23 of the road-side device (kept in a non-operated state). As the road-side device controller 24 receives in step S606 the discriminating information, the controller 24 sends it via step S608 to the encrypting/decrypting key retrieving device 25. The encrypting/decrypting key retrieving device 25 retrieves an encrypting/decrypting key corresponding to the received discriminating information from (i.e., referring to) the discriminating information encrypting/decrypting key corresponding table memory 26 and sets it in the encrypting/decrypting device 23 of the road-side device. In this case, since a predetermined relationship between the discriminating information and the encrypting/decrypting key is known from a content of the discriminating information encrypting/decrypting key corresponding table memory 26 (i.e., is set by the manager of the automatic charge receipt system), the encrypting/decrypting key set at the encrypting/decrypting device 23 of the road-side device is the same as the encrypting/decrypting key used by the encrypting/decrypting device 13 of the vehicle-mounted device 1.

Then, in a step S610, the road-side device controller 24 generates a random number R1 and transmits it to the vehicle-mounted device 1. After this operation, the encrypting/decrypting device 23 of the road-side device is set via a step 614 to be operated for encrypting/decrypting, and a response from the vehicle-mounted device is monitored via a step S616. As long as no response is received, the road-side device 2 continues to loop through the step S616.

As the discriminating and confining controller 135 detects receipt in a step S510 of the random number R1 sent from the road-side device 2, the road-side device controls the encryptor 131 and the decryptor 132 via a step S512 to be operated for encryption/decryption. Then, via a step S514 a random number R2 is generated and in combination with the random number R1 (sent from the road-side device 2), is transmitted via step S516 to the road-side device 2. At this time, since the encryptor 131 is now kept at an operational (i.e., encryption) state, the communication content is encrypted. In this case, the encrypted random numbers R1 and R2 are expressed as e (R1¦R2). After this operation, the discriminating and confirming controller 135 monitors via a step S518 whether a response is received from the road-side device 2. As long as no response is received, the vehicle-mounted device 1 continues to loop through the step S518.

Returning discussion to the road-side device 2, e (R1¦R2) sent from the vehicle-mounted device 1 is decoded when it is passed through the encrypting/decrypting device 23 of the road-side device 2. In this case, the decrypted result of the returned random number R1 is expressed as R1'. If the encrypting/decrypting keys of the road-side device 2 and the vehicle-mounted device 1 coincide with each other, R1' and R1 are found in step S618 to coincide with each other. However, if the encrypting/decrypting keys of the road-side device 2 and the vehicle-mounted device 1 do not coincide with each other, R1' and R1 do not coincide with each other. Thus, a comparison in the step S618 of the original random number R1, and the returned random number R1' can be used by the road-side device 2 to determine whether the active road-side and vehicle-mounted encrypting/decrypting keys match. If in the road-side device controller 24, R1' and R1 are found to coincide with each other, processing continues as coincidence of keys is confirmed, and in turn, if they are found not to coincide with each other, the operation returns to the initial step S602.

More particularly, if coincidence of keys is found in step S618, the road-side device controller 24 transmits the random number R2 via step S620, back to the vehicle-mounted device 1. More specifically, the random number R2 is encrypted with the encryptor 23 of the road-side device and is transmitted. In this case, the encrypted random number R2 is expressed as e(R2). After this operation, the road-side device controller 24 waits (step unshown) for a subsequent communication from the vehicle-mounted device 1 and upon receipt of such communication, starts to perform a charge receipt processing via a step S622. Once charge receipt processing is completed, the operation of the road-side device 2 is ended in a step S624, or returns (not illustrated) to the step S600 to restart operations for a next approaching vehicle.

Returning discussion to the vehicle-mounted device 1, (FIG. 5), e (R2) sent from the road-side device 2 is decrypted by the decryption device 132, and thereafter, enters the discriminating and confirming control device 135. In this case, the encrypted/decrypted result of the original random number R2 is expressed as R2'. If in a step S520 the encrypting/decrypting keys of the road-side device 2 and the vehicle-mounted device 1 are found to coincide with each other, R2' and R2 will coincide with each other. In contrast, if the encrypting/decrypting keys of the road-side device 2 and the vehicle-mounted device 1 are different from each other, R2' and R2 do not coincide with each other and processing is returned to step S504. Thus, a comparison in the step S520 of the original random number R2 and the returned random number R2' can be used by the vehicle-mounted device 1 to determine whether the active road-side and vehicle-mounted encrypting/decrypting keys match. The discriminating and confirming controller 135, if R2 and R2' coincide with each other, uses the step S522 to change an inputting source (i.e., terminal) of the first switch 137 and an outputting destination (i.e., terminal) of the second switch 138 from the discriminating and confirming controller 135 to the vehicle-mounted device controller 14 so as to enable the vehicle-mounted device controller 14 to communicate with the road-side device 2. Step S524 represents an end of processing, or alternatively processing can be returned to the step S500 or S502.

As described above, if coincidence of keys is confirmed at both the vehicle-mounted device 1 and the road-side device 2, subsequently the vehicle-mounted device controller 14 and the road-side device 2 freely communicate with each other to proceed with the processing of charge receipt. In contrast, in coincidence of keys is not confirmed, further charge receipt processing does not proceed..

In the preferred embodiment of the present invention, the encrypting/decrypting device 13 communicates with the road-side device 2 so as to perform a mutual confirmation of coincidence of keys, so is to maintain and confirm security for the vehicle-mounted device controller 14 to have a function for processing the charge collecting operation. In addition, in the case that it is desired to also keep the fact or occurrence of mutual confirmation in secret, it is easy to keep such fact or occurrence from being leaked under entire management of the encryptor 13 (as it is easy to keep other information such as encrypting/decrypting keys or the like secret) due to the situation that such fact or occurrence or information can remain contained within the discriminating and confirming controller 135.

The above-describe authentication protocol is more specifically called a 3-way authentication protocol in that information is exchanged in three directions to perform authentication, i.e., 1.) a random number R1 is sent from the road-side device to the vehicle-mounted device, 2.) a combination of random numbers R1/R2 is returned back from the vehicle-mounted device to the road-side device, and 3.) the random number R2 is returned back from the road-side device to the vehicle-mounted device. Other types of authentication protocols are equally applicable for use with the present invention, e.g., a 2-way×2 authentication protocol and a Fiat-Shimir authentication protocol.

Figure 3:
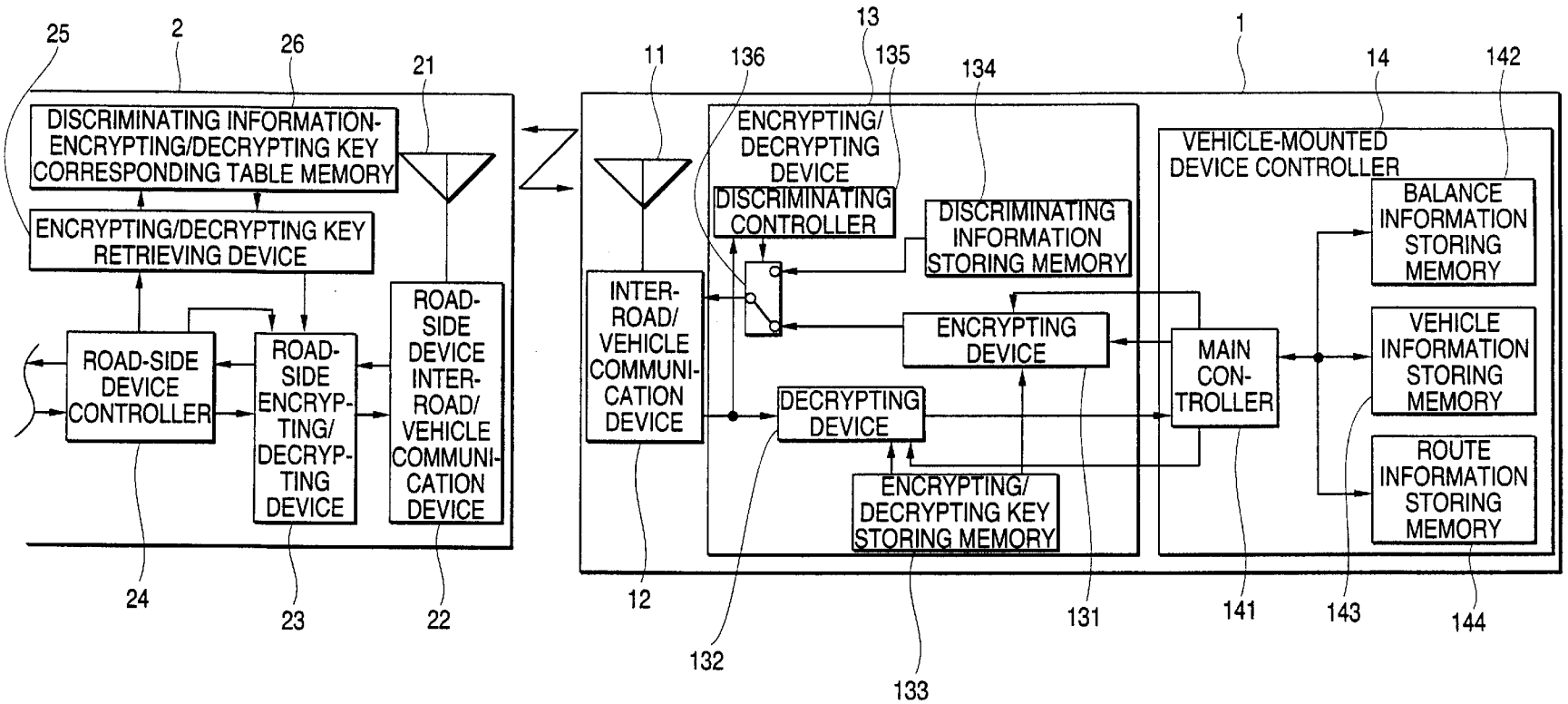
FIG. 3 is a block diagram showing still another preferred embodiment of the present invention.

A still further preferred embodiment of the vehicle-mounted vehicle of the automatic charge receipt system of the present invention will be now described. In this preferred embodiment, although a mutual confirmation (i.e., authentication) is carried out between the aforesaid vehicle-mounted device and the aforesaid road-side device, its feature consists in the fact that controlling/executing functions thereof are performed by the aforesaid main controller. More particularly, FIG. 3 is a block diagram showing a vehicle-mounted device of this preferred embodiment. Since basic components of this preferred embodiment are the same or similar to those of the aforesaid preferred embodiment except the operations of the encrypting/decrypting device 13 and the main controller 141, redundant description of components other than these components is omitted.

The encrypting/decrypting device 13 is comprised of: an encryptor 131; a decryptor 132; an encrypting/decrypting key storing memory 133; a discriminating information storing memory 134; a discriminating controller 135; and, a switch 136. The encryptor 131 encrypts a communication sent from the vehicle-mounted device controller 14 to deliver it to the inter-road/vehicle communicating device 12. The decryptor 132 receives encrypted communication (originally from the road-side device) from the inter-road/ vehicle communication device 12, decodes it and then delivers it to the vehicle-mounted device controller 14. The encryptor 131 and the decryptor 132 are controlled using control line/signals from the main controller 141 in order to select such devices to an operational/non-operational state, i.e., under the non-operating state, a communication is not encrypted/decrypted, but instead, such communication is outputted as it is. In addition, the encrypting/decrypting key storing memory 133 again (like previous embodiments) stores the encrypting/decrypting key applied for encrypting/decrypting processing, wherein the encryptor 131 and the decryptor 132 obtain copies of the encrypting/decrypting key from the encrypting/decrypting key storing memory 133.

The discriminating information storing memory 134 has, as its content, information for discriminating (i.e., uniquely identifying) the vehicle-mounted device from other vehicle-mounted devices in the system, and this information and the aforesaid encrypting/decrypting key are set in each of the discriminating information storing memory 134 and the encrypting/decrypting key storing memory 133, respectively, in advance by the manager of the automatic charge receipt system. In addition, the manager of the automatic charge receipt system records all the corresponding relationships between the discriminating information of all vehicle-mounted devices and the encrypting/decrypting keys in the discriminating information encrypting/decrypting key corresponding table memory 26.

The switch 136 selects an input to the inter-road/vehicle communication device 12 between the encryptor 131 and the discriminating information storing memory 134 under a control line/signal from the discriminating controller 135. The discriminating controller 135 controls the switch 136 when the inter-road/vehicle communication is started, such that the discriminating information of the aforesaid discriminating information storing memory 134 is sent to the road-side device 2 through the inter-road/vehicle communication device 12 without encryption.

In the preferred embodiment, the main controller 141 has a responsibility/function for controlling processings for confirmation of coincidence of keys, in addition to a function for controlling a communication of the charge receipt. Since details of such processings is the same or similar to that of the previous preferred embodiment, redundant discussion is omitted.

According to the above preferred embodiment, it is possible to perform a concurrent transmission of communication for receipt of charge in a midway part of the confirmation in a case where a mutual confirmation procedure defined in ISO9798-2 of the International Standards Organization is utilized, and thus it is possible to reduce a number of times of communication.

Figure 4:
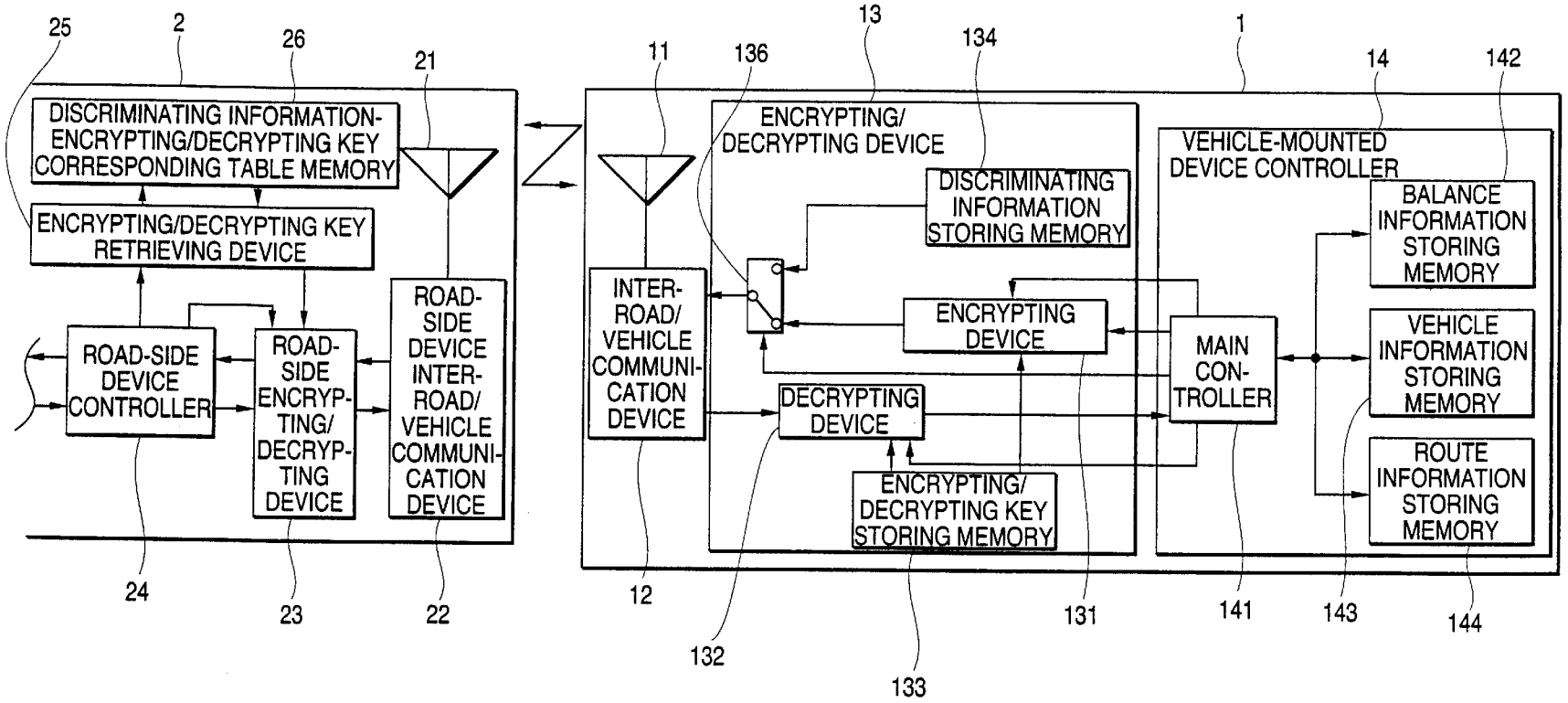
FIG. 4 is a block diagram showing yet another preferred embodiment of the present invention.

Next, a further preferred embodiment of the vehicle-mounted device of the present invention will be described. In such preferred embodiment, a function of the discriminating controller of the previous preferred embodiment is performed by the aforesaid main controller 141. More particularly, FIG. 4 is a block diagram showing the vehicle-mounted device of such preferred embodiment. Since the preferred embodiment is the same as the previous preferred embodiment except for construction of the encrypting/decrypting device 13 and the operation of the main controller 141, redundant description concerning other components/sections is omitted.

The encrypting/decrypting device 13 is comprised of: the encryptor 131; the decryptor 132; the encrypting/decrypting key storing memory 133; the discriminating information storing memory 134; and, the switch 136. Since the functions of the encryptor 131, the decryptor 132 and the encrypting/decrypting key storing memory 133 are the same as those of the previous preferred embodiment, redundant description thereof is omitted.

The discriminating information storing memory 134 has, as its content, information for discriminating (i.e., uniquely identifying) the vehicle-mounted device from other vehicle-mounted devices in the system, and this information and the aforesaid encrypting/decrypting keys are set in advance in each of the discriminating information storing memory 134 and the encrypting/decrypting key storing memory 133, respectively by the manager of the automatic charge receipt system. Under a control of the main controller 141 via a control line/signal, the switch 136 selects an input for the inter road/vehicle communication device 12 between the encryptor 131 and the discriminating information storing memory 134.

More particularly, in such preferred embodiment, the main controller 141 controls the switch 136 when the inter-road/vehicle communication is started so as to send the discriminating information content of the aforesaid discriminating information storing memory 134 to the roadside device 2 through the inter-road-vehicle communication device 12 without encrypting. Subsequently, the main controller 141 performs confirmation of coincidence of keys in a manner similar to that of previous embodiments and accordingly, redundant description thereof is eliminated. According to this preferred embodiment, it is possible to simplify the configuration of the encrypting/decrypting device 13 by delegating responsibilities/functions to the main controller 141.

According to the present invention, since the aforesaid encryptor and the aforesaid decryptor are arranged in a communication path between the road-side device and the vehicle-mounted device controller, it is not necessary for the aforesaid vehicle-mounted device controller to perform a utilization charge communication until the intermediate encrypting/decrypting device confirms coincidence of the road-side and vehicle-mounted encrypting/decrypting keys. In addition, since the aforesaid encrypting/decrypting key is contained within and is not transferred to a location outside of the aforesaid encrypting/decrypting device, it becomes easy to monitor security and leakage of the aforesaid encrypting/decrypting key. In particular, if the aforesaid encrypting/decrypting device is realized with a single, tamper resistant integrated circuit, an internal analysis thereof is difficult physically, thus enhancing an integrity and security of the system. More particularly, under utilization of the aforesaid encrypting/decrypting device, it is possible to design and manufacture the vehicle-mounted device while the encrypting/decrypting keys remain secure and hidden.

In addition, in a case where confirmation is carried out before communication of the charge receipt, the order of procedure of confirmation of coincidence of keys is performed by the aforesaid intermediary encrypting/decrypting device. Upon completion of the confirmation, a communication passage is opened/allowed to the aforesaid vehicle-mounted device controller, resulting in that it is not necessary for the aforesaid vehicle-mounted device controller to itself consider confirmation. As another advantage, since the procedure of confirmation and information required for confirmation are contained within the aforesaid encrypting/decrypting device, prevention of leakage of the procedure of confirmation or information required for confirmation can be maintained.

In addition, even in a case where the order of procedure of the confirmation is controlled by the aforesaid vehicle-mounted device controller, information required for confirmation is still contained within the aforesaid encrypting/decrypting device, resulting in that it becomes easy to manage the prevention of leakage of information required for the confirmation in the same manner as that of the previous preferred embodiment. As another advantage not found in the previous preferred embodiment, in case of use of a procedure of confirmation as defined in ISO9798-2, for example, it is possible to perform a concurrent transmission of the communication of the charge receipt midway through confirmation, so that a number of times of communications can be decreased. Since the vehicle passes at a high speed in a range where communication can be performed in the automatic charge receipt system, this reduction in a number of times of communications is quite preferable in view of minimizing a time and/or bandwidth of the communication with respect to each vehicle.

This concludes the description of the preferred embodiments. Although the present invention has been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangement within the scope of the foregoing disclosure, the drawings and the appended claims without departing from the spirit of the invention.

What is claimed is:

1. A vehicle-mounted device having at least a function to communicate with a road-side device for meeting a utilization charge in an automatic charge collecting system while a vehicle travels on a utilization charge road, said vehicle-mounted device comprising:

a discrimination information memory for holding discrimination information for uniquely identifying at least one of said vehicle-mounted device and a user;

a discrimination information provider for providing said discrimination information from said discrimination information memory to said road-side device;

an encrypting/decrypting key memory for holding at least one encrypting/decrypting key;

an encryptor for encrypting information sent to said road-side device using said at least one encrypting/decrypting key; and a decryptor for decrypting encrypted information from said road-side device using said at least one encrypting/decrypting key;

wherein said vehicle-mounted device communicates said discrimination information to said road-side device without being encrypted by said encryptor;

further comprising a selector arrangement for selectably controlling so as to allow communications to be handled within said vehicle-mounted device with or without encrypting/decrypting.

2. A vehicle-mounted device as claimed in claim 1, wherein said selector arrangement is more specifically for allowing said discrimination information to be transmitted without being encrypted.

3. A vehicle-mounted device as claimed in claim 1, wherein said selector arrangement is more specifically for conducting a predetermined portion of communications pertaining to discrimination information transmission without encrypting/decrypting and conducting other portions of communications using encrypting/decrypting.

4. A vehicle-mounted device as claimed in claim 1, wherein said discrimination controller receives an input communication from said road-side device without such input communication being processed by said decryptor, and wherein said selector arrangement is more specifically comprised of:

a switch controlled by a signal obtained from said discrimination controller, for selecting an output of said vehicle-mounted device to correspond to an output of one of said discrimination information memory and said encryptor.

5. A vehicle-mounted device as claimed in claim 1, wherein said selector arrangement is more specifically comprised of:

an encrypting/decrypting controller for controlling at least one of said encryptor and said decryptor, for selectively stopping/starting an ecrypting/decrypting operation thereof so as to allow communications to be handled within said vehicle-mounted device with or without encrypting/decrypting.

6. A vehicle-mounted device as claimed in claim 5, wherein said device further comprises:

a utilization charge processor for receiving communications from said road-side device through said decryptor for meeting the utilization charge determined by said road-side device; and wherein said selector arrangement is further comprised of:

a first switch controlled for selecting an input to said encryptor between said utilization charge processor and said discrimination controller; and a second switch controlled for selecting an output from said decryptor to be delivered to one of said utilization charge processor and said discrimination controller.

7. A vehicle-mounted device as claimed in claim 5, wherein said device further comprises:

a switch controlled for selecting an output of said vehicle-mounted device to correspond to an output of one of said discrimination information memory and said encryptor.

8. A vehicle-mounted device as claimed in claim 7, wherein said device further comprises:

a utilization charge processor for receiving communications from said road-side device through said decryptor for meeting the utilization charge determined by said road-side device;

wherein said discrimination controller controls selecting of said switch, and wherein said utiliztion charge processor controlling starting/stopping of said at least one of said encryptor and said decryptor.

9. A vehicle-mounted device as claimed in claim 7, wherein said device further comprises:

a utilization charge processor for receiving communications from said road-side device through said decryptor for meeting the utilization charge determined by said road-side device;

wherein said utilization charge processor controls selecting of said switch, and controls starting/stopping of encrypting/decrypting of said at least one of said encryptor and said decryptor.

10. A vehicle-mounted device having at least a function to communicate with a road-side device for meeting a utilization charge in an automatic charge collecting system while a vehicle travels on a utilization charge road, said vehicle-mounted device comprising:

a discriminator having a discrimination information memory for holding discrimination information for uniquely identifying at least one of said vehicle-mounted device and a user;

a switch for conducting a predetermined portion of communications without using encrypting/decrypting and conducting other portions of the communications using encrypting/decrypting;

an ecrypting/decrypting key memory for holding at least one encrypting/decrypting key used in authentication and encrypting/decrypting; and an authenticator/cryptographer unit for performing authentication and encrypting/decrypting using an encryptor and a decryptor and said at least one encrypting/decrypting key;

wherein said discrimination information memory, said switch, said encrypting/decrypting key memory and at least portions of said authenticator/cryptographer unit are provided in a tamper-/access-resistant unit.

11. A vehicle-mounted device as claimed in claim 10, wherein said tamper-/access-resistant unit is more specifically an integrated circuit.

12. A vehicle-mounted device as claimed in claim 11, further comprising a selector arrangement for selectably controlling activation/deactivation of encrypting/decryting so as to allow communications to be handled within said vehicle-mounted device with or without encrypting/decrypting.

13. A vehicle-mounted device as claimed in claim 12, wherein said selector arrangement is more specifically for allowing said discrimination information to be transmitted without being encrypted.

14. A vehicle-mounted device as claimed in claim 12, wherein said selector arrangement is more specifically for conducting a predetermined portion of communications pertaining to discrimination information transmission without encrypting/decrypting and conducting other portions of communications using encrypting/decrypting.

15. A vehicle-mounted device as claimed in claim 12, wherein said discriminator receives an input communication from said road-side device without such input communication being subjected to decrypting, and wherein said selector arrangement is more specifically comprised of:

a switch controlled by a signal obtained from said discriminator, for selecting an output of said vehicle-mounted device to correspond to an output of one of said discrimination information memory and said encryptor.

16. A vehicle-mounted device as claimed in claim 12, wherein said selector arrangement is more specifically comprised of:

an encrypting/decrypting controller for controlling at least one of said encryptor and said decryptor for selectively stopping/starting an ecrypting/decrypting operation thereof, so as to allow communications to be handled within said vehicle-mounted device with or without encrypting/decrypting.

17. A vehicle-mounted device as claimed in claim 16, wherein said device further comprises:

a utilization charge processor for receiving communications from said road-side device through said decryptor for meeting the utilization charge determined by said road-side device; and wherein said selector arrangement is further comprised of:

a first switch controlled for selecting an input to said encryptor between said utilization charge processor and said discriminator; and a second switch controlled for selecting an output from said decryptor to be delivered to one of said utilization charge processor and said discriminator.

18. A vehicle-mounted device as claimed in claim 16, wherein said device further comprises:

a switch controlled for selecting an output of said vehicle-mounted device to correspond to an output of one of said discrimination information memory and said encryptor.

19. A vehicle-mounted device as claimed in claim 18, wherein said device further comprises:

a utilization charge processor for receiving communications from said road-side device through said decryptor for meeting the utilization charge determined by said road-side device;

wherein said discriminator controls selecting of said switch, and wherein said utiliztion charge processor controlling starting/stopping of encrypting/decrypting of said at least one of said encryptor and said decryptor.

20. A vehicle-mounted device as claimed in claim 18, wherein said device further comprises:

a utilization charge processor for receiving communications from said road-side device through said decryptor for meeting the utilization charge determined by said road-side device;

wherein said utilization charge processor controls selecting of said switch, and controlling starting/stopping of encrypting/decrypting of said at least one of said encryptor and said decryptor.

21. A vehicle-mounted device as claimed in claim 10, wherein said tamper-/access-resistant unit is more specifically at least one of a welded-sealed unit, an epoxy-sealed unit, a resin-sealed unit, and a unit which at least one of self-destructs and self-disables upon unauthorized tampering/access thereof.

22. A vehicle-mounted device having at least a function to communicate with a road-side device for meeting a utilization charge in an automatic charge collecting system while a vehicle travels on a utilization charge road, said vehicle-mounted device comprising:

an encryptor for encrypting a communication delivered from said vehicle-mounted device to said road-side device;

a decryptor for decrypting an encrypted communication delivered from said road-side device to said vehicle-mounted device;

a encrypting/decrypting key memory connected to said encryptor and said decryptor, for holding/providing at least one encrypting/decrypting key used in said encryptor and said decryptor;

a discrimination information memory for holding a discriminating information uniquely identifying said vehicle-mounted device;

a discrimination controller for transmitting a content of said discrimination information memory to said road-side device without passing through said encryptor;

a utilization charge processor for receiving communications from said road-side device through said decryptor for meeting the utilization charge determined by said road-side equipment;

wherein said discrimination controller controlling at least one of said encryptor and said decryptor for selectively stopping an encrypting/decrypting operation thereof, so as to allow communications to travel through said at least one of said encryptor and said decryptor without encrypting/decrypting; and wherein said discrimination controller carries out a communication with said road-side device in a predetermined order to perform a discriminating communication.

* * * * *